US010984922B2

(12) United States Patent
Urushihara et al.

(10) Patent No.: US 10,984,922 B2
(45) Date of Patent: Apr. 20, 2021

(54) INSULATED ELECTRIC WIRE, METHOD FOR MANUFACTURING SAME, AND COIL

(71) Applicant: MITSUBISHI MATERIALS CORPORATION, Tokyo (JP)

(72) Inventors: Makoto Urushihara, Hitachinaka (JP); Hideaki Sakurai, Amagasaki (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 0 days.

(21) Appl. No.: 16/484,592

(22) PCT Filed: Feb. 13, 2018

(86) PCT No.: PCT/JP2018/004837
§ 371 (c)(1),
(2) Date: Aug. 8, 2019

(87) PCT Pub. No.: WO2018/159279
PCT Pub. Date: Sep. 7, 2018

(65) Prior Publication Data

US 2020/0043629 A1 Feb. 6, 2020

(30) Foreign Application Priority Data

Mar. 1, 2017 (JP) ..... JP2017-038489

(51) Int. Cl.
*H01B 3/30* (2006.01)
*H01B 7/00* (2006.01)
(Continued)

(52) U.S. Cl.
CPC ..... *H01B 3/305* (2013.01); *C25D 9/02* (2013.01); *H01B 1/02* (2013.01); *H01B 3/306* (2013.01);
(Continued)

(58) Field of Classification Search
CPC ..... H01B 3/305; H01B 3/306; H01B 1/02; H01B 7/0009; H01B 7/02; H01B 13/16; H01F 27/2823
See application file for complete search history.

(56) References Cited

U.S. PATENT DOCUMENTS

2014/0066314 A1* 3/2014 Maeda ..... H01L 39/247 505/230
2016/0307663 A1* 10/2016 Ikeda ..... H01B 13/065
(Continued)

FOREIGN PATENT DOCUMENTS

CN 105900185 A 8/2016
CN 106062894 A 10/2016
(Continued)

OTHER PUBLICATIONS

International Search Report dated Mar. 13, 2018, issued for PCT/JP2018/004837 and English translation thereof.
(Continued)

*Primary Examiner* — Timothy J Thompson
*Assistant Examiner* — Amol H Patel
(74) *Attorney, Agent, or Firm* — Locke Lord LLP

(57) ABSTRACT

There is provided an insulated electric wire comprising a conductor wire coated by an insulating film, in which the insulating film contains 5 to 20% by mass of a low boiling point component having a boiling point of less than 300° C. under normal pressure. The insulating film preferably has a thickness of 40 to 65 μm. The conductor wire preferably has a cross-sectional shape in a rectangular shape or a square shape.

14 Claims, 2 Drawing Sheets

(51) Int. Cl.

| | |
|---|---|
| ***H01B 7/02*** | (2006.01) |
| ***H01B 1/02*** | (2006.01) |
| ***H01B 13/16*** | (2006.01) |
| ***H01F 27/28*** | (2006.01) |
| ***C25D 9/02*** | (2006.01) |

(52) U.S. Cl.
CPC ..... *H01B 7/0009* (2013.01); *H01B 7/02* (2013.01); *H01B 13/16* (2013.01); *H01F 27/2823* (2013.01)

(56) References Cited

U.S. PATENT DOCUMENTS

| | | | | |
|---|---|---|---|---|
| 2016/0322126 | A1* | 11/2016 | Oya | H01B 7/0216 |
| 2017/0044322 | A1* | 2/2017 | Noguchi | C08G 73/1032 |
| 2018/0127600 | A1 | 5/2018 | Iida et al. | |

FOREIGN PATENT DOCUMENTS

| | | | | |
|---|---|---|---|---|
| EP | 2587493 | A1 | | 5/2013 |
| EP | 3418336 | A1 | | 12/2018 |
| JP | 56-104941 | A | | 8/1981 |
| JP | 2010-108758 | A | | 5/2010 |
| JP | 2010-251615 | A | | 11/2010 |
| JP | 2010251615 | A | * | 11/2010 |
| JP | 2013-035997 | A | | 2/2013 |
| JP | 2015-011861 | A | | 1/2015 |
| WO | 2016/190164 | A1 | | 12/2016 |

OTHER PUBLICATIONS

Office Action dated Mar. 19, 2020, issued for the Chinese patent application No. 201880010389.4 and English translation thereof.
Supplementary European Search Report dated Dec. 3, 2020, issued for European Patent Application No. 18760547.2.
Decision of Rejection dated Dec. 15, 2020, issued for Japanese Patent Application No. 2017-038489 and English translation thereof.

* cited by examiner

INSULATED ELECTRIC WIRE, METHOD FOR MANUFACTURING SAME, AND COIL

TECHNICAL FIELD

The present invention relates to an insulated electric wire for winding including a conductor wire coated by an insulating film, a method for manufacturing the same, and a coil. More specifically, the present invention relates to an insulated electric wire in which when bending is performed, the adhesion of an inner side of bending of an insulating film to a conductor wire is excellent, the flexibility of an outer side of bending of the insulating film is excellent, and the softening resistance of the insulating film is excellent; a method for manufacturing the same; and a coil.

Priority is claimed on Japanese Patent Application No. 2017-038489, filed on Mar. 1, 2017, the content of which is incorporated herein by reference.

BACKGROUND ART

In recent years, a hybrid vehicle or an electric vehicle requires a high-performance reactor or a high-performance motor. Accordingly, as an insulated electric wire for a coil used in the reactor or motor, a rectangular wire having a cross-sectional shape in a rectangular shape becomes more popularly used instead of a round wire having a cross-sectional circular shape, and in the manufacturing of the coil, an edgewise bending process becomes more popularly used instead of a flatwise bending process. To further improve the high performance of the reactor or motor, a reduction of a bending radius in the edgewise bending process is required. In the edgewise bending process, if the bending radius is reduced, an inner side of bending of a film is likely to peel from a conductor, and wrinkles are likely to occur in the film. Breaking or a fracture occurs in an outer side of bending of the film. The defects cause a decrease in insulation performance which is the most important factor of the insulated electric wire. In order to prevent the occurrence of peeling and wrinkles, a rectangular insulated electric wire having high adhesion is required in which a film does not peel from a conductor even when bending is performed.

There is proposed an insulated electric wire using an insulating film having excellent adhesion to a conductor even after a heating treatment is performed, and having softening resistance even under high load conditions (for example, refer to PTL 1). The insulated electric wire has a primer layer obtained by coating a surface of the conductor with a phenoxy resin insulating varnish which contains 100 parts by mass of phenoxy resin which is formed of 80 to 30% by mass of bisphenol-A type phenoxy resin and 20 to 70% by mass of bisphenol-S type phenoxy resin, and which contains 5 to 50 parts by mass of blocked isocyanate, and by baking the coated conductor.

CITATION LIST

Patent Literature

[PTL 1] Japanese Unexamined Patent Application, First Publication No. 2010-108758 (A) (claim 1, claim 3, and paragraph [0007])

SUMMARY OF INVENTION

Technical Problem

Because the insulated electric wire illustrated in PTL 1 requires a primer layer, there is the problem that a step of manufacturing the insulated electric wire becomes complicate, and manufacturing costs increase. In addition, there is the problem that it is difficult to manufacture the insulated electric wire while maintaining consistent product quality.

An object of the present invention is to solve the problems, and to provide an insulated electric wire in which when bending is performed, the adhesion of an inner side of bending of an insulating film to a conductor wire is excellent, the flexibility of an outer side of bending of the insulating film is excellent, and the softening resistance of the insulating film is excellent; a method for manufacturing the same; and a coil.

Conventionally, in a case where an identical baking furnace is used for: conductor wires having varying shapes or types; or insulating films having varying thicknesses, it was necessary to evaluate each of: the softening resistance of insulating films; and the adhesion and the flexibility of insulating films with respect to conductor wires, in each case, since dryness states of insulating films differ even if they are baked in the same drying condition. The inventors have reached the present invention based on the views that the percentage of the content of a low boiling point component having a boiling point of 300° C. under normal pressure in an insulating film affects the softening resistance and the adhesion and flexibility of the insulating film.

Solution to Problem

According to a first aspect of the present invention, there is provided an insulated electric wire including a conductor wire coated by an insulating film, in which the insulating film contains 5 to 20% by mass of a low boiling point component having a boiling point of less than 300° C. under normal pressure.

In the insulated electric wire of a second aspect of the present invention according to the first aspect, the insulating film has a thickness of 40 to 65 μm.

In the insulated electric wire of a third aspect of the present invention according to the first or second aspect, the conductor wire has a cross-sectional shape in a rectangular shape or a square shape.

In the insulated electric wire of a fourth aspect of the present invention according to the third aspect, the conductor wire has a cross-sectional shape in a rectangular shape, a ratio (long side/short side ratio) of a length of a long side to a length of a short side of the cross section is in a range of 4 to 50, and an equivalent round wire diameter of the conductor wire is in a range of 3 to 5 mm. The equivalent round wire diameter represents a diameter of a true circle line, the cross-sectional area of which is the same as the cross-sectional area of a conductor wire having a cross-sectional shape other than a true circle.

In the insulated electric wire of a fifth aspect of the present invention according to any one of the first to fourth aspects, the conductor wire is a copper wire, and a material of the insulating film is a polyamide-imide resin or a polyimide resin.

According to a sixth aspect of the present invention, there is provided a method for manufacturing the insulated electric wire according to any one of the first to fifth aspects, the method including forming the insulating film by electrodepositing an electrodeposition dispersion to the conductor wire.

According to a seventh aspect of the present invention, there is provided a coil formed by winding the insulated electric wire according to any one of the first to fifth aspects multiple turns.

According to an eighth aspect of the present invention, there is provided a coil formed by winding the insulated electric wire according to the fourth aspect multiple turns edgewise.

Advantageous Effects of Invention

In the first aspect of the present invention, because the insulated electric wire contains 5% or greater by mass of the low boiling point component having a boiling point of less than 300° C. under normal pressure in 100% by mass of the insulating film, when bending is performed, the adhesion of an inner side of bending of the insulating film to the conductor wire is excellent, and the flexibility of an outer side of bending of the insulating film is excellent. Because the content of the low boiling point component is less than or equal to 20% by mass and is not excessive, the insulating film has excellent softening resistance.

In the second aspect of the present invention, because the thickness of the insulating film is greater than or equal to 40 μm, an insulation breakdown voltage is high and heat resistance is excellent. Because the thickness of the insulating film is less than or equal to 65 μm, when bending is performed, the adhesion of the inner side of bending of the insulating film to the conductor wire becomes even better.

In the third aspect of the present invention, because the conductor wire has a cross-sectional shape in a rectangular shape or a square shape, when the insulated electric wire is wound into a coil, the ratio of the occupancy of a cross-sectional area of the conductor wire to a cross-sectional area of the coil is capable of increasing compared to when the conductor wire has a cross-sectional shape in a circular shape.

In the fourth aspect of the present invention, because the conductor wire has a cross-sectional shape in a rectangular shape and the ratio (long side/short side ratio) of the length of the long side to the short side of the cross section is greater than or equal to four, when the insulated electric wire carries high-frequency alternating current, and current flows only at a skin of the conductor due to skin effect, a current flowing region is capable of being widened due to the high long side/short side ratio. Because the long side/short side ratio is less than or equal to 50, bending is easily performed, and when bending is performed, the adhesion of the inner side of bending of the insulating film to the conductor wire becomes even better. Because the equivalent round wire diameter of the conductor wire is greater than or equal to 3 mm, the insulated electric wire is capable of being used as an insulated electric wire for high current. Because the equivalent round wire diameter is less than or equal to 5 mm, when bending is performed, the adhesion of the inner side of bending of the insulating film to the conductor wire in the insulated electric wire becomes even better. If high current flows through the insulated electric wire, high insulation performance attainable by a thick insulating film is required. On the other hand, if the insulating film is thick, because bending is likely to cause wrinkles and peeling, the present invention is preferable in such case.

In the fifth aspect of the present invention, because the conductor wire is a copper wire, conductivity is excellent. Because the material of the insulating film is a polyamide-imide resin or a polyimide resin, the insulation breakdown voltage is high and heat resistance is excellent.

In the sixth aspect of the present invention, because the insulating film is formed by electrodepositing the electrodeposition dispersion to the conductor wire, the insulating film is capable of being uniformly formed on a surface of the conductor wire.

In the coil according to the seventh aspect of the present invention which is formed by winding the insulated electric wire multiple turns, the insulating film of the insulated electric wire does not wrinkle and peel from the conductor wire, and breaking does not occur in the insulating film.

In the coil according to the eighth aspect of the present invention which is formed by winding the insulated electric wire of the fourth aspect multiple turns edgewise, the ratio of the occupancy of the cross-sectional area of the conductor wire to the cross-sectional area of the coil is capable of increasing.

DESCRIPTION OF EMBODIMENTS

Figure 1:
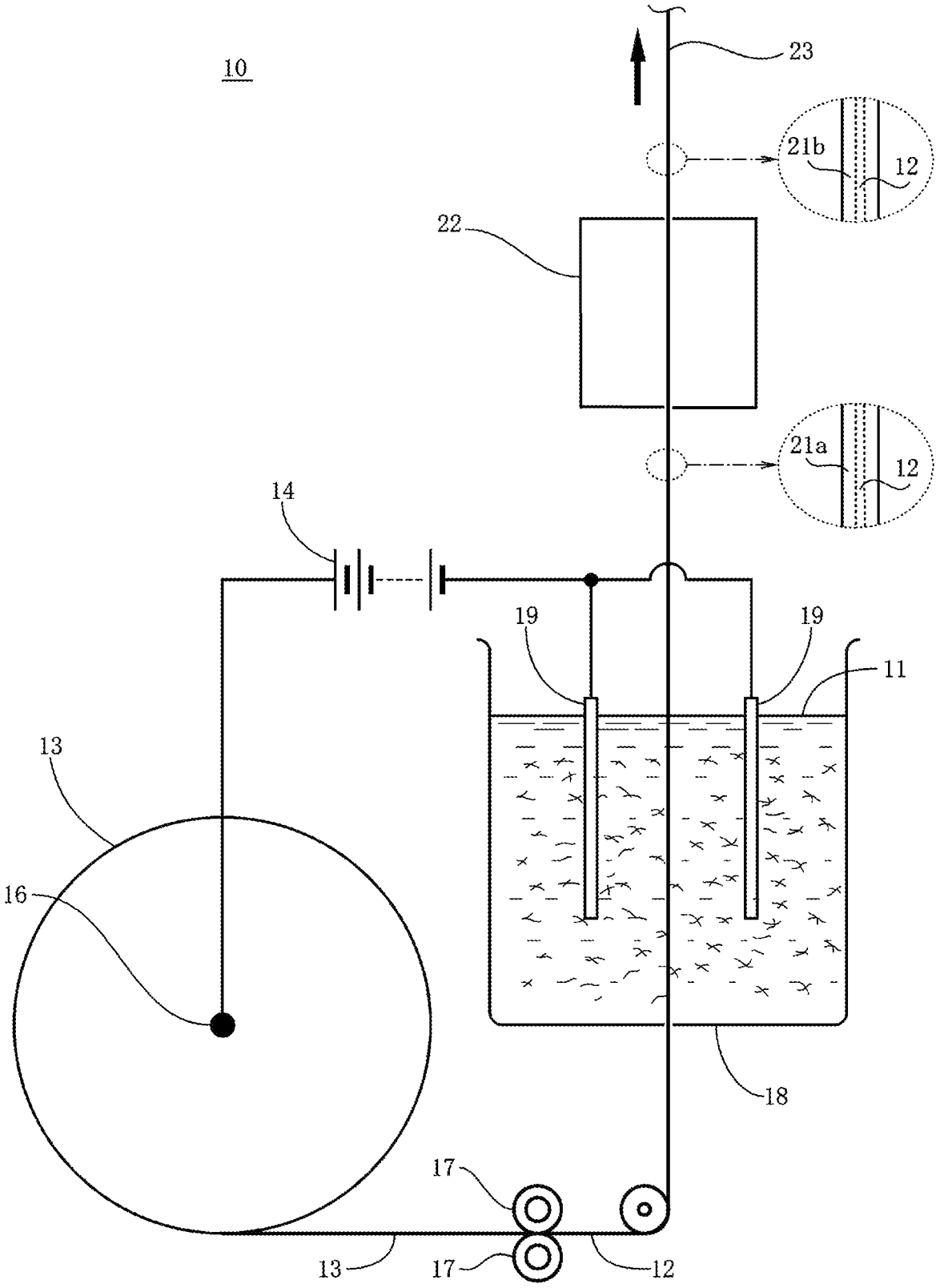
FIG. 1 is a schematic diagram illustrating a process of forming an insulating film on a surface of a conductor wire of an embodiment of the present invention.

Subsequently, an embodiment of the present invention will be described.

<Insulated Electric Wire>

An insulated electric wire of the embodiment is an insulated electric wire obtained by coating a conductor wire with an insulating film. A distinguishing point of the insulated electric wire is that the insulating film contains 5 to 20% by mass of a low boiling point component having a boiling point of less than 300° C. under normal pressure. The insulating film preferably contains 8 to 17% by mass of a low boiling point component having a boiling point of less than 300° C. under normal pressure. The reason a boiling point of 300° C. is used as a reference boiling point is that when the insulated electric wire is baked, an unnecessary solvent is capable of being quickly removed around the temperature, and if a boiling point of 400° C. or higher is used as a reference boiling point, the insulating film deteriorates. Examples of the low boiling point component having a boiling point of less than 300° C. under normal pressure include water and an organic solvent. Examples of the organic solvent include N, N-dimethylformamide (DMF), N, N-dimethylacetamide (DMAc), dimethylsulfoxide (DMSO), N-methylpyrrolidone (NMP), γ-butyrolactone (yBL), anisole, tetramethylurea, and sulfolane. Among the exemplified organic solvents, NMP is preferably used as the organic solvent. The reason the insulating film contains 5 to 20% by mass of a low boiling point component having a boiling point of less than 300° C. under normal pressure is that if the content of the low boiling point component is less than 5% by mass, the insulating film becomes hardened, and thus, an inner side of bending of the insulating film may wrinkle or peel from the conductor wire or an outer side of bending of the insulating film may break in a bending process which is a winding process. If the content of the low boiling point component exceeds 20% by mass, the insulating film has inferior softening resistance at a high temperature of 200° C. or higher in the winding process.

The insulating film of the embodiment preferably has a thickness of 40 to 65 μm. If the thickness of the insulating film is less than 40 μm, the film may be too thin to exhibit insulation performance that can be used in motors and reactors. If the thickness of the insulating film exceeds 65 μm, the inner side of bending of the insulating film is likely to wrinkle or peel from the conductor wire in the bending process which is the winding process. If coating is performed via electrodeposition, because the volatile amount of the solvent increases, defects such as bubbles are likely to occur in the film in a baking step.

In the embodiment, the conductor wire of the insulated electric wire may have a cross-sectional shape in a circular shape. The conductor wire preferably has a cross-sectional shape in a rectangular shape or a square shape because when the insulated electric wire is wound into a coil, the ratio of the occupancy of a cross-sectional area of the conductor wire to a cross-sectional area of the coil is capable of increasing compared to when the conductor wire has a cross-sectional shape in a circular shape.

If the conductor wire of the insulated electric wire of the embodiment has a rectangular shape, preferably, the ratio (long side/short side ratio) of a long side to a short side of a rectangular cross section of the conductor wire is greater than or equal to four, and an equivalent round wire diameter is greater than or equal to 3 mm. The reason is that when the insulated electric wire is wounded into a coil, the ratio of the occupancy of the cross-sectional area of the conductor wire to the cross-sectional area of the coil is capable of increasing. Particularly, if the long side/short side ratio is greater than or equal to four, when the insulated electric wire carries high-frequency alternating current, and when the current flows only on a surface of the conductor due to skin effect, a current flowing region is capable of being widened due to the high long side/short side ratio. Preferably, the long side/short side ratio is less than or equal to 50, and when the conductor wire is converted to a round wire, the diameter of the round wire is less than or equal to 5 mm. The reason is that when bending is performed, the bending is capable of being easily performed and the adhesion of the inner side of bending of the insulating film to the conductor wire becomes even better. If the long side/short side ratio exceeds 50, the degree of flatness of the rectangular conductor wire becomes excessively large, and the conductor wire is likely to be twisted or to break due to bending.

In the embodiment, examples of the material of the conductor wire of the insulated electric wire include copper, a copper alloy, aluminum, an aluminum alloy, and a stainless steel. A wire made of copper among the exemplified materials is preferably used because the wire made of copper has a higher conductivity. Examples of the material of the insulating film include a polyimide (hereinafter, referred to as PI) resin, a polyamide-imide (hereinafter, referred to as PAI) resin, a polyester imide resin, an acrylic resin, an epoxy resin, an epoxy acrylic resin, a polyurethane resin, and a polyester resin. In the viewpoint of a high insulation breakdown voltage and a high heat resistance, a polyamide-imide resin or a polyimide resin among the exemplified materials is preferably used as the material of the insulating film <Method for Manufacturing Insulated Electric Wire>

The insulated electric wire of the embodiment is manufactured by forming an insulating film on a conductor wire via a dipping method or electrodeposition method. If the insulating film is formed by the dipping method, the thickness of a film applicable per one time in a film coating step is 1 to 10 μm. It is necessary to perform the coating step and the baking step multiple times in order to obtain an insulation breakdown voltage required for use in a motor or reactor for a hybrid vehicle or an electric vehicle. In this case, because it is necessary to perform the baking step multiple times, the drying of an inner layer of film proceeds further compared to the drying of an outer layer of film. Therefore, it is necessary to implement a scheme to change coating dose each time in repetitions of the coating step or a scheme to change a temperature each time in repetitions of the baking step in order to make the degree of drying uniform over the entire films. Particularly, as the baking step is performed many times, a first layer of film in contact with the conductor reaches a high degree of drying and becomes hardened, thereby causing floating in a coil process. For this reason, it is necessary to implement a scheme to perform the drying of the first layer of film at a low temperature.

In the present invention, the insulating film is preferably formed by the electrodeposition method. The reason is that a film of 1 to 100 μm is applicable all at once and the baking step is complete all at once, and thus a mass reduction of the insulating film is easily controlled. If the electrodeposition method is used, firstly, an electrodeposition dispersion is prepared which is insulating electrodeposition coating material. The electrodeposition dispersion contains a polymer, and an organic solvent and water which serve as a solvent. Example of the polymer include the resins exemplified as the material of the insulating film. Examples of the organic solvent include the organic solvents exemplified as the low boiling point component.

In the embodiment, after a neutralizing agent is added into a polyamide-imide solution and a polyimide solution in which a polyamide-imide resin and a polyimide resin serving as polymers are dissolved in NMP and DMI, and a mixture of the solutions and the resins is stifled to neutralize polyamide-imide and polyimide, the polyamide-imide and the polyimide are precipitated by adding water (which is a bad solvent for the polyamide-imide and the polyimide) into the mixture, and mixing together and stirring the water and the mixture, and as a result, the electrodeposition dispersion is prepared.

Hereinbelow, a method for manufacturing the insulated electric wire using the electrodeposition dispersion will be described with reference to FIG. 1. As illustrated in FIG. 1, an electrodeposition coating apparatus 10 has an electrodeposition bath 18 storing an electrodeposition dispersion 11, and a baking furnace 22. The electrodeposition dispersion 11 is a water-based electrodeposition dispersion in which a polymer is dispersed in water, or a mixture-based electrodeposition dispersion in which a polymer is dispersed in a mixture of water and an organic solvent. A dispersing medium of the electrodeposition dispersion 11 is water or water/organic solvent which is a low boiling point component having a boiling point of less than 300° C. under normal pressure. The concentration of the polymer is 1 to 10% by mass in 100% by mass of the dispersing medium. If the dispersing medium is a mixed solvent of water and the organic solvent, the concentration of the organic solvent preferably is 1 to 70% by mass.

A conductor wire 13 having a cross-sectional shape in a circular shape which is wound around a cylinder is electrically connected to a positive electrode of a DC power supply 14 via an anode 16 in advance. The conductor wire 13 having a cross-sectional shape in a circular shape is pulled upward in the direction of the solid arrow illustrated in FIG. 1, and goes through the following each step.

Firstly, in a first step, a rectangular conductor wire 12 having a rectangular cross-sectional shape is formed by flat rolling the conductor wire 13 having a circular cross-sectional shape via a pair of rolling rollers 17, 17. Subsequently, in a second step, the rectangular conductor wire 12 passes through the electrodeposition dispersion 11 stored in the electrodeposition bath 18. A pair of cathodes 19, 19 electrically connected to a negative electrode of the DC power supply 14 is inserted into the electrodeposition dispersion 11 in the electrodeposition bath 18. The rectangular conductor wire 12 passes between the pair of cathodes 19, 19.

The temperature of the electrodeposition dispersion 11 is preferably maintained at a temperature of 5 to 60° C. When the rectangular conductor wire 12 passes through the electrodeposition dispersion 11 in the electrodeposition bath 18, a DC voltage is applied between the rectangular conductor wire 12 and the cathodes 19, 19 by the DC power supply 14. The DC voltage from the DC power supply 14 preferably is in a range of 1 to 500 V, and an energization time of a DC current preferably is in a range of 0.01 to 60 seconds. Therefore, negatively charged polymer particles (not illustrated) are electrodeposited onto a surface of the rectangular conductor wire 12 in the electrodeposition dispersion 11 such that an insulating layer 21*a* is formed as illustrated in a partially magnified view of FIG. 1.

Subsequently, a baking treatment is performed on the rectangular conductor wire 12 having the surface electrodeposited with the insulating layer 21*a* such that an insulating film 21*b* is formed on the surface of the rectangular conductor wire 12 as illustrated in a partially magnified view of FIG. 1. In the embodiment, the baking treatment is performed by passing the rectangular conductor wire 12 having the insulating layer 21*a* formed on the surface through the baking furnace 22. In the baking treatment, the following furnaces individually or in combination may be used: a near-infrared heating furnace, a hot air heating furnace, an induction heating furnace, a far-infrared heating furnace, and a furnace using temperature-controlled air or temperature-controlled inert gas such as nitrogen. Hot air heating and infrared heating are preferably used in combination to speed up drying. In the hot air heating, in a state where the temperature of a furnace is set in a range of 200 to 500° C., high-speed gas may be used, and drying gas may be introduced into the furnace such that an average flow speed of the gas inside the furnace is approximately in a range of 1 to 10 m/min. Desirably, a gas temperature is set approximately in a range of 200 to 500° C. for the same reason as in the temperature of the furnace. The time of the baking treatment is preferably set in a range of 1 to 10 minutes. If the temperature of the baking treatment is less than 200° C., the required drying is not attainable, and if the temperature exceeds 500° C., the rapid volatilization of the solvent at an initial phase of drying is capable of causing defects such as bubbles in a film. The resin may be thermally decomposed due to the high temperature. The temperature of the baking treatment represents the temperature of a central part inside the baking furnace.

The baking treatment is a treatment which is important to determine the adhesion of the inner side of bending of the insulating film to the conductor wire and the flexibility of the outer side of bending of the insulating film when the insulated electric wire is bent which will be described, and the softening resistance of the insulating film. If the baking is excessive, when the insulated electric wire is bent, an inner side of bending of the insulating film may wrinkle or peel from the conductor wire, or the outer side of bending of the insulating film may break due to the deterioration of resins and the oxidation of interfaces. If the baking is not sufficient, because the organic solvent becomes excessively present in the insulating film, a softening temperature decreases.

Figure 2:
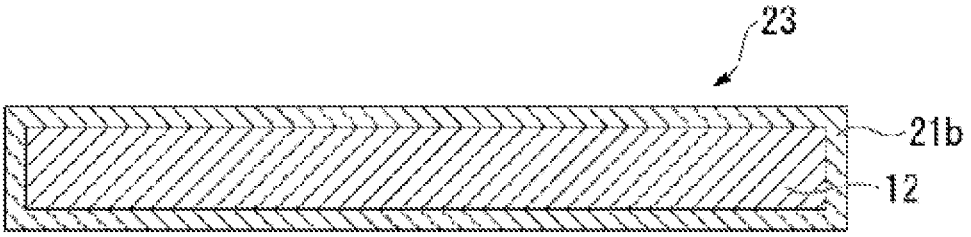
FIG. 2 is a schematic cross-sectional shape illustrating an insulating film (21*b*) on a surface of a conductor wire (12) of the present invention.

An insulated electric wire 23 is manufactured by passing the rectangular conductor wire 12 through the baking furnace 22, and is configured such that the surface of the rectangular conductor wire 12 is coated with the insulating film 21 *b*, as illustrated in a schematic cross-sectional view of FIG. 2.

<Method for Manufacturing Coil>

Figure 3:
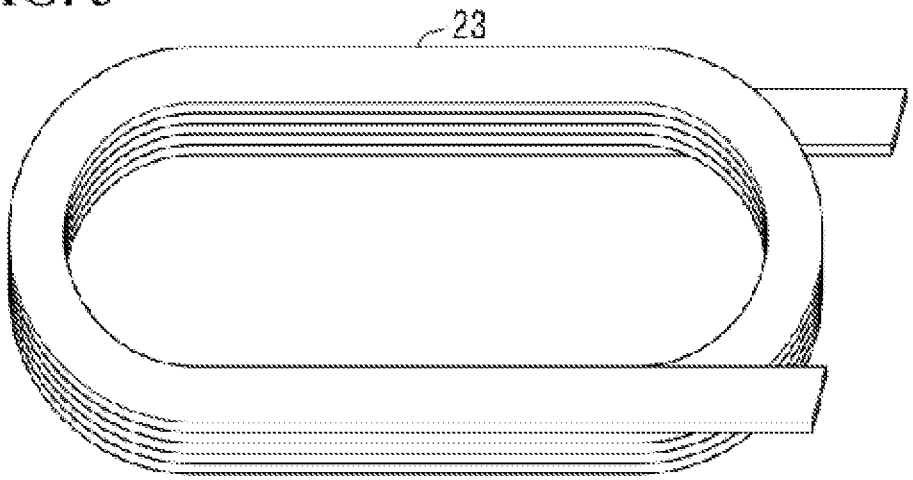
FIG. 3 is a schematic view illustrating a coil of the present invention is formed by winding the insulated electric wire multiple turns.

A coil is manufactured by winding the insulated electric wire 23 formed by coating the rectangular conductor wire 12 with the insulating film 21 *b*, via a coil forming apparatus (not illustrated). In the embodiment, the coil is manufactured by a winding process which is an edgewise bending process of bending the insulated electric wire such that one short side (edge surface) of the conductor wire having a cross-sectional shape in a rectangular shape becomes an inner-diameter surface, and the other short side (edge surface) becomes an outer-diameter surface, as illustrated in a schematic view of FIG. 3. The coil may be manufactured from the insulated electric wire by a winding process which is a flatwise bending process of bending long sides (flat surfaces) of the conductor wire having a cross-sectional shape in a rectangular shape.

EXAMPLES

Subsequently, examples and comparative examples of the present invention will be described in detail.

Example 1

A rectangular copper wire having a thickness of 1.5 mm and a width of 6.5 mm was prepared as a conductor wire. An electrodeposition bath was prepared which had cathodes formed of a pair of copper sheets and a length of 1 m to store an electrodeposition dispersion. A baking furnace was prepared which was an electric furnace (far-infrared heating furnace) having a length of 2.5 m, in which a thermocouple was installed on a furnace wall, and the inner temperature of which was capable of being set to a desired temperature. In the baking furnace, a plurality of electric heaters were provided in a traveling direction of the copper wire, the temperatures of the electric heaters were capable of being individually set such that only part of the copper wire in a desired range of length was capable of being baked, and an output of each heater was set such that only part of the copper wire in a length of 1.2 m was capable of being baked.

Firstly, a water-based electrodeposition dispersion containing 2% by mass of polyamide-imide (PAI) was stored in the electrodeposition bath. The temperature of the electrodeposition dispersion was maintained at a temperature of 20° C., and a DC voltage of 100 V was applied between the copper wire (anode) and the copper sheets (cathodes). Electrodeposition was performed by passing the copper wire between the pair of cathodes while adjusting the feeding speed of the copper wire fed by a feeding machine (not illustrated). The copper wire having a surface electrodeposited with an insulating layer was introduced into the drying/baking furnace, and the feeding speed of the feeding machine was adjusted to 0.4 m/min, and as a result, an insulated electric wire was manufactured to have an insulating film having a thickness of 40 μm on each single surface of the insulated electric wire.

Table 1 illustrates a main component of the electrodeposition dispersion, long and short sides of the rectangular conductor wire, an equivalent round wire diameter of the rectangular conductor wire, and conditions (feeding speed, applied voltage, drying method, drying temperature, length of heating portion/hot air portion of the furnace, and hot air speed) for manufacturing the insulated electric wire in Example 1.

Examples 2 to 7 and Comparative Examples 1 to 4

Insulated electric wires of Examples 2 to 7 and Comparative Examples 1 to 4 were manufactured under the condition that a main component of each electrodeposition dispersion, long and short sides of each rectangular conductor wire, an equivalent round wire diameter of each rectangular conductor wire, and conditions for manufacturing each insulated electric wire were changed as illustrated in Table 1, and other factors were set as illustrated in Example 1. In Examples 6 and 7 and Comparative Example 4, hot air heating furnaces having the respective lengths illustrated in Table 1 were used for a baking treatment. In each of the hot air heating furnaces used, a plurality of hot air feeding inlets for feeding hot air into the furnace were attached in the traveling direction of the copper wire, and a mechanism for capable of baking part of the copper wire in a desired length by the hot air was provided. In Examples 6 and 7 and Comparative Example 4, hot air was introduced into a longitudinal part of a hot air portion of each furnace illustrated in Table 1, and the baking treatment was performed at each hot air speed illustrated in Table 1. The hot air speed indicates a value at an outlet of each furnace.

(1) Film Thickness of Insulating Film

The value of the film thickness of each insulating film was obtained by measuring the thickness of the entire insulated electric wire in a state where long sides of each insulating film were interposed between a micrometer (manufactured by MITUTOYO corporation), subtracting the thickness (length of a short side of a conductor) of the conductor wire from the measured thickness of the entire insulated electric wire, and then multiplying the obtained value by ½.

(2) Mass Reduction of Insulating Film

Part of the insulating film, which was peeled from the conductor wire of each insulated electric wire by a cutter knife, was heated under air circulation at a speed of 10° C./min from a room temperature to a temperature of 300° C. by a thermogravimetric analyzer. The mass of the insulating film was measured at a room temperature, and then when the temperature reached 300° C., a difference in the mass of the insulating film was obtained. The mass reduction was deemed as the mass of a low boiling point component contained in the insulating film.

(3) Flexibility and Adhesion of Insulating Film

The flexibility and adhesion of each insulating film was determined by cutting a 10 cm length piece from each insulated electric wire, bending the piece of the insulated electric wire at 90 degrees via an edgewise bending process to form a shape following the shape of a round bar (round bar having a diameter equal to the length of a long side of a cross-sectional shape in a rectangular shape of the insulated electric wire) having an equivalent diameter, and then examining the existence (adhesion) of wrinkles and peeling of the inner side of bending of the insulating film and the existence (flexibility) of breaking of the outer side of bending by magnifying the bent piece 20 times using an optical microscope.

(4) Softening Temperature of Insulating Film

The softening temperature of each insulating film was measured according to JIS (C3216-6:2011-4, steel ball method).

TABLE 1

| | | Cross Section of Rectangular Conductor Wire | | | Equivalent Round | Conditions for Manufacturing Insulated Electric Wire | | | | | |
|---|---|---|---|---|---|---|---|---|---|---|---|
| | Material of Insulating Film | Long Side (mm) | Short Side (mm) | Long Side/Short Side | Wire Diameter (mm) | Feeding Speed (m/min) | Applied Voltage (V) | Drying Method | Drying Temperature (° C.) | Length of Heating Portion/Hot Air Portion of Furnace (m) | Hot Air Speed (m/min) |
| Example 1 | PAI | 6.5 | 1.5 | 4.3 | 3.5 | 0.4 | 100 | Infrared | 250 | 1.2 | — |
| Example 2 | PAI | 6.5 | 1.5 | 4.3 | 3.5 | 0.35 | 100 | Infrared | 250 | 1.7 | — |
| Example 3 | PAI | 6.5 | 1.5 | 4.3 | 3.5 | 0.3 | 100 | Infrared | 300 | 0.9 | — |
| Example 4 | PI | 6.5 | 1.5 | 4.3 | 3.5 | 0.4 | 100 | Infrared | 250 | 1.2 | — |
| Example 5 | PAI | 6.5 | 1.5 | 4.3 | 3.5 | 0.4 | 500 | Infrared | 250 | 1.6 | — |
| Example 6 | PAI | 6.5 | 1.5 | 4.3 | 3.5 | 0.2 | 60 | Hot Air | 200 | 2.4 | 6.0 |
| Example 7 | PAI | 18 | 0.4 | 45 | 3.0 | 0.55 | 100 | Hot Air | 300 | 0.5 | 3.5 |
| Comparative Example 1 | PAI | 6.5 | 1.5 | 4.3 | 3.5 | 0.25 | 100 | Infrared | 300 | 1.3 | — |
| Comparative Example 2 | PAI | 6.5 | 1.5 | 4.3 | 3.5 | 0.5 | 100 | Infrared | 200 | 1.5 | — |
| Comparative Example 3 | PI | 6.5 | 1.5 | 4.3 | 3.5 | 0.5 | 100 | Infrared | 200 | 1.5 | — |
| Comparative Example 4 | PAI | 18 | 0.4 | 45 | 3.0 | 0.35 | 100 | Hot Air | 300 | 0.7 | 3.5 |

<Evaluation of Comparison Test>

The following elements of each of the insulated electric wires obtained in Examples 1 to 7 and Comparative Examples 1 to 4 were examined by methods described hereinbelow: a film thickness of each insulating film, a mass reduction of each insulating film, the flexibility and adhesion of each insulating film, and a softening temperature of each insulating film. Table 2 illustrates the results.

TABLE 2

| | Insulating Film | | | | | |
|---|---|---|---|---|---|---|
| | Material | Film Thickness (μm) | Mass Reduction (%) | Peeling/Wrinkle of Inner Side of Bending | Breaking of Outer Side of Bending | Softening Temperature (° C.) |
| Example 1 | PAI | 40 | 17 | No | No | 309 |
| Example 2 | PAI | 40 | 11 | No | No | 312 |
| Example 3 | PAI | 40 | 10 | No | No | 310 |
| Example 4 | PI | 40 | 16 | No | No | 322 |
| Example 5 | PAI | 65 | 17 | No | No | 302 |
| Example 6 | PAI | 40 | 8 | No | No | 315 |
| Example 7 | PAI | 40 | 16 | No | No | 307 |
| Comparative Example 1 | PAI | 40 | 4 | Yes | Yes | 343 |
| Comparative Example 2 | PAI | 40 | 24 | No | No | 209 |
| Comparative Example 3 | PI | 40 | 23 | No | No | 211 |
| Comparative Example 4 | PAI | 40 | 4 | Yes | Yes | 351 |

As is apparent from Table 2, in Comparative Examples 1 and 4, because the mass reduction percentage of each insulating film was 4%, in each flexibility and adhesion test, wrinkles and peeling were observed in the inner side of bending of the insulating film of the insulated electric wire, and breaking was observed in the outer side of bending of the insulating film. In Comparative Examples 2 and 3, because each mass reduction percentage was large, in other words, the percentage of the low boiling point component in each insulating film was high, the softening temperatures were 209° C. and 211° C., respectively, and the insulating films had inferior softening resistance.

On the other hand, in Examples 1 to 7, because the mass reduction percentages of the insulating films were in a range of 5 to 20%, in each flexibility and adhesion test, wrinkles and peeling were not observed in the inner side of bending of the insulating film of the insulated electric wire, and breaking was not observed in the outer side of bending of the insulating film. In Examples 1 to 7, the softening temperatures were in a range of 302 to 322° C., and the insulating films had excellent softening resistance.

INDUSTRIAL APPLICABILITY

An insulated electric wire of the present invention is capable of being used as a coil for use in a reactor or motor for a hybrid vehicle or an electric vehicle.

REFERENCE SIGNS LIST

10: electrodeposition coating apparatus
11 electrodeposition dispersion
12: rectangular conductor wire
13: conductor wire having a cross-sectional shape in a circular shape
21*b*: insulating film
23: insulated electric wire

The invention claimed is:

1. An insulated electric wire comprising a conductor wire coated by an insulating film, wherein the insulating film contains 5 to 20% by mass of a low boiling point component having a boiling point of less than 300° C. under normal pressure after the insulated electric wire being subjected to a baking treatment, and the conductor wire has a cross-sectional shape in a rectangular shape, a ratio (long side/short side ratio) of a length of a long side to a length of a short side of the cross section is in a range of 4.3 to 50, and an equivalent round wire diameter of the conductor wire is in a range of 3 to 5 mm.

2. The insulated electric wire according to claim 1, wherein the insulating film has a thickness of 40 to 65 μm.

3. The insulated electric wire according to claim 2, wherein the conductor wire is a copper wire, and a material of the insulating film is a polyamide-imide resin or a polyimide resin.

4. A method for manufacturing the insulated electric wire according to claim 2, the method comprising:

forming the insulating film by electrodepositing an electrodeposition dispersion to the conductor wire having a cross-sectional shape in a rectangular shape, a ratio (long side/short side ratio) of a length of a long side to a length of a short side of the cross section is in a range of 4.3 to 50, and an equivalent round wire diameter of the conductor wire is in a range of 3 to 5 mm.

5. A coil formed by winding the insulated electric wire according to claim 2 multiple turns.

6. A coil formed by winding the insulated electric wire according to claim 2 multiple turns.

7. The insulated electric wire according to claim 1, wherein the conductor wire is a copper wire, and a material of the insulating film is a polyamide-imide resin or a polyimide resin.

8. A method for manufacturing the insulated electric wire according to claim 7, the method comprising:

forming the insulating film made of a polyamide-imide resin or a polyimide resin by electrodepositing an electrodeposition dispersion to the conductor wire having a cross-sectional shape in a rectangular shape, a ratio (long side/short side ratio) of a length of a long side to a length of a short side of the cross section is in a range of 4.3 to 50, and an equivalent round wire diameter of the conductor wire is in a range of 3 to 5 mm.

9. A coil formed by winding the insulated electric wire according to claim 7 multiple turns.

10. A method for manufacturing the insulated electric wire according to claim 1, the method comprising forming the insulating film by electrodepositing an electrodeposition dispersion on the conductor wire having a cross-sectional shape in a rectangular shape, a ratio (long side/short side ratio) of a length of a long side to a length of a short side of the cross section is in a range of 4.3 to 50, and an equivalent round wire diameter of the conductor wire is in a range of 3 to 5 mm.

11. A coil formed by winding the insulated electric wire according to claim 1 multiple turns.

12. A coil formed by winding the insulated electric wire according to claim 1 multiple turns edgewise.

13. The insulated electric wire according to claim 1, wherein a mass reduction of the insulating film is 5 to 20% by mass, wherein the mass reduction of the insulating film was measured by the mass percentage change at a room temperature, and then at a temperature of 300° C.:

$$\text{mass reduction\%} = \frac{\text{mass at room temperature} - \text{mass at 300° C. (after heating)}}{\text{mass at room temperature}} \times 100\%;$$

and wherein the insulating film was peeled from the conductor wire of the insulated electric wire for the mass reduction measurement after the insulated electric wire being subjected to a baking treatment.

14. The insulated electric wire according to claim 1, wherein the low boiling point component is water or an organic solvent selected from a group consisting of N, N-dimethylformamide (DMF), N, N-dimethylacetamide (DMAc), dimethylsulfoxide (DMSO), N-methylpyrrolidone (NMP), γ-butyrolactone (γBL), anisole, tetramethylurea, and sulfolane.

* * * * *